United States Patent [19]

Levy

[11] 4,149,887

[45] Apr. 17, 1979

[54] PHOTOGRAPHY UTILIZING MICRO-CAPSULAR MATERIALS

[76] Inventor: Sidney Levy, 145 W. Cuthbert Blvd., Oaklyn, N.J. 08107

[21] Appl. No.: 499,840

[22] Filed: Aug. 23, 1974

[51] Int. Cl.[2] ..... G03C 1/76; G03G 5/04; G03C 1/40; G03C 1/00

[52] U.S. Cl. ..... 96/67; 96/1.5 R; 96/77; 96/88

[58] Field of Search ..... 96/98, 29 D, 29 R, 77, 96/90 PC, 75, 1.5, 3, 88, 76 R, 67, 14; 427/144

[56] References Cited

U.S. PATENT DOCUMENTS

| | | | |
|---|---|---|---|
| 3,080,251 | 3/1963 | Claus | 96/1.5 |
| 3,301,439 | 1/1967 | Kosar et al. | 96/88 X |
| 3,318,697 | 5/1967 | Shrewsbury | 96/1R |
| 3,329,590 | 7/1967 | Renfrew | 96/1.5 X |

*Primary Examiner*—J. Travis Brown
*Assistant Examiner*—L. Falasco
*Attorney, Agent, or Firm*—Friedman, Goodman & Teitelbaum

[57] ABSTRACT

A micro-capsular material for use as a photographic reproducing medium includes a plurality of micro-capsules distributed over a given surface. Each of the capsules is formed with a mantle of light transmissive material. The mantles may be clear or colored and are advantageously transparent. The contents of each of the capsules includes a photoconductive material as well as a color progenitor or precursor material. Simultaneous exposure of the capsular material to light and high frequency electrical energy causes rupture of the capsule mantles and release of the capsular contents. When an image is focused by a lens onto the surface, selected ones of said capsules are ruptured to thereby result in a reproduction of the image. Dispersing micro-capsules having different color progenitor materials makes possible color photography when means are provided for selectively directing only those component of colored light onto the micro-capsules having corresponding color progenitor materials. In this manner, only the desired micro-capsules are ruptured which include color progenitor materials corresponding to the light components impinging thereon.

6 Claims, 4 Drawing Figures

PHOTOGRAPHY UTILIZING MICRO-CAPSULAR MATERIALS

BACKGROUND OF THE INVENTION

The present invention generally relates to a micro-capsular material adapted to release the encapsulated contents thereof, and more particularly, by way of a specific example, to a photographic method and apparatus which can form monochromatic or photographic developing steps, monochromatic or color reproductions by focusing an image on a surface treated or coated with micro-capsular materials.

The term "micro-capsule" as herein employed is intended to designate a minute or microscopic capsule wherein a nucleous or microscopic drop of liquid material is surrounded by a mantle of relatively impervious material. The mantle is relatively thin and pressure rupturable. Micro-capsules of the type to which reference is here made have been formed by coacervation as well as by methods involving interfacial polycondensation. The structures and methods of forming capsules of this type are described in the patented art and literature. Reference, by way of example, is made to the following United States Letters Patents: U.S. Pat. No. Re. 24,899, Nov. 29, 1960, B. K. Green; U.S. Pat. Nos. 2,299,693, Oct. 20, 1942, B. K. Green; 2,374,862, May 1, 1945, B. K. Green; 2,548,366, Apr. 10, 1951, B. K. Green et al; 2,730,456, Jan. 10, 1956, B. K. Green et al; 2,730,457, Jan. 10, 1956, B. K. Green et al; 2,800,457, July 23, 1957, B. K. Green et al; 2,800,458, July 23, 1957, B. K. Green; 2,953,470, Sept. 20, 1960, B. K. Green et al; 2,971,916, Feb. 14, 1961, L. Schleicher et al; 2,988,461, June 13, 1961, H. J. Eichel; 3,016,308, Jan. 9, 1962, N. Macaulay; 3,069,370, Dec. 18, 1962, E. H. Jensen et al.

A description of the interfacial polycondensation method is found in abandoned United States Patent Application Ser. No. 813,425 and in SPE Transactions of Jan. 1963, at page 71. Further reference may be made in this connection to U.S. Pat. No. 3,524,726 and British Pat. Nos. 1,138,590 and 1,161,039.

A principal application of such capsules has been as a coating upon a substratum to produce pressure responsive record or transfer materials. In such cases, the coating of the micro-capsular material is subjected to mechanical impact or pressure, whereby the capsule mantles or walls are broken or ruptured. The capsule contents are thus exposed and released. In some cases the exposed material is reactive with the atmosphere to produce physical markings or indicia while in other applications the exposed or released material is brought into contact with additional reactive substances for similar purposes. Exposure or release of the encapsulated material may be desired for transfer contact as well as a variety of other uses.

The present application discloses a photographic arrangement wherein a recording material of the type generally similar to those above described is utilized in photography for reproducing optical images with the assistance of high frequency electrical energy field, such as an R-F field (Radio Frequency Alternating Current Field).

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

DESCRIPTION OF THE PREFERRED EMBODIMENTS

Figure 2:
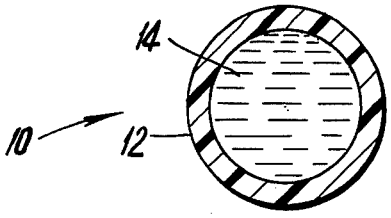
FIG. 2 is a cross section of a single micro-capsule of the type used to coat the recording surface utilized in the apparatus of FIG. 1.

The present invention, broadly described, is for a method and apparatus for releasing, selectively or generally, encapsulated contents of a plurality of micro-capsules. A description of the micro-capsules of the type which are contemplated for this application will now be set forth with reference to FIG. 2. An individual micro-capsule is shown and referenced by the numeral 10. It will be understood that in actual applications of the present invention, a multiplicity of micro-capsules will be utilized and distributed as will be described hereafter.

Each micro-capsule 10 is formed with a mantle 12 which is made of a light transmissive material and is rupturable. The mantle 12 is generally spherical in nature and encloses or encapsulates a predetermined amount of material, as will be more specifically described hereafter.

As will become evident from the description that follows, the ability to release the contents 14 of the micro-capsules at will may find numerous applications. Applications may suggest themselves to those skilled in the art where release of the contents of all the micro-capsules may be desirable under given conditions or where the contents of only selected ones of said micro-capsules are to be released. The discussion that follows will be in reference to a micro-capsular material for use as a photographic recording medium. In this application, the micro-capsules are generally selectively ruptured in order to generate the reproduction of an image. However, the description that follows should not be construed as limiting and is given only by way of example.

Where the micro-capsular material is utilized in photography, the material 14 is in the form of a dye or a color progenitor material. While the color progenitor or precursor material may be solid, it is presently contemplated that this material be in the nature of a liquid. As will become evident, the liquid 14 may itself be in the form of a dye or may be a colorless dye precursor material which acquires the color upon a given reaction subsequent to rupture of the capsule.

The contents of each of the capsules 10 further includes a photoconductive material to modify the electrical conductivity of the encapsulated material as a function of the intensity of light which impinges thereon. The electrical conductivity of the material 14 is advantageously very low when little or no light impinges on the capsule 10 and increases rapidly with increasing levels of light.

The mantle 12 of each micro-capsule 10 must be light transmissive to permit light to pass therethrough in order to effect the conductivity of the material 14. In this sense, the mantle 12 may be either translucent or transparent. The mantle 12 may either be clear or colorless or may assume a transparent color wherein the mantle 12 acts as an optical filter, as will be further discusses hereafter.

While the liquid or material 14 has been described as being a dye or color progenitor as well as being photoconductive, the liquid 14 may contain two separate agents which impart these distinct properties to the liquid. Alternately, the progenitor material within the liquid 14 may itself be photoconductive. Similarly, the photoconductive material may be a color precursor or progenitor.

The mantles 12 have been described above as being rupturable. The characteristics of the micro-capsules 10 are advantageously such that the mantles 12 rupture at such time that the capsules are simultaneously exposed to light and a high frequency electrical energy field. It is believed that such simultaneous exposure decreases the electrical resistivity of the encapsulated material and permits increased current flow within the respective capsules, this representing an increase in absorption of electrical energy. When the capsules have absorbed an amount of energy sufficient to raise the internal temperature and thereby pressure of the capsules, the mantles are ruptured. On the other hand, when insufficient light impinges upon the capsules, the resistivity within the same remains high and absorption of high frequency energy remains low.

Figure 1:
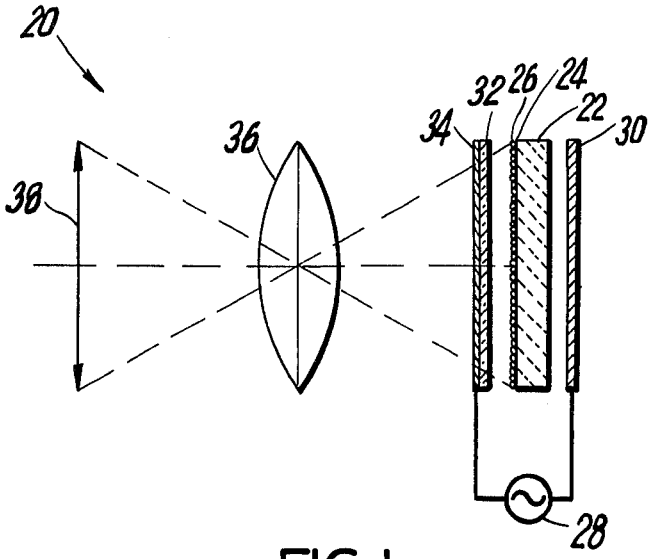
FIG. 1 is a schematic representation of a photographic apparatus in accordance with the present invention which utilizes micro-capsular materials.

An exemplary schematic arrangement is shown in FIG. 1 for one application of the micro-capsular material suggested above. The optical arrangement in FIG. 1 is essentially of a camera 20 which is not unlike a conventional camera. The camera 20 includes an electrically non-conductive substrate sheet 22 which is uniformly coated with an electrically non-conductive base coating or matrix in which are dispersed micro-capsules 26 of the type described with reference to FIG. 2. The substrate sheet 22 and the micro-capsules 26 are analogous to conventional photographic film and, in this instance the micro-capsules 26 are positioned at the focal plane of the camera 20.

A high frequency electrical energy field generating means is provided in the form of a high frequency voltage source 28 connected respectively to a pair of spaced parallel electrical conductive elements. One of the elements is in the form of a flat electrically conductive sheet 30 which is spaced from and parallel to the substrate sheet 22, as viewed in FIG. 1. The other conductive element connected to the high frequency voltage source 28 includes a planar glass sheet 32 on which is deposited a layer of tin oxide coating 34. The glass sheet 32 is transparent as is the tin oxide coating. The latter coating is additionally electrically conductive. In this manner, the high frequency current source is connected across two spaced parallel electrically conductive elements 30, 34 and the capsular material 26 is disposed within a high frequency electrical energy field established between the conductive elements when the energy generating means 28 is connected to the latter.

As with conventional cameras, an optical lens 36 is spaced from the focal plane in which the micro-capsules 26 are disposed so that the lens 36 may focus an image of an object 38 onto the micro-capsular plane.

The principle of operation of the present invention will now be described in connection with FIG. 1. When light does not impinge on the micro-capsules 26, the electrical resistance of the encapsulated material 14 is high, as above described. Accordingly, placing such high resistance micro-capsules within a high frequency electrical radiation or energy field, such as a R-F field, does not result in heating of the micro-capsule. Advantageously, as suggested above, the base coating 24 as well as the substrate sheet 22 are made from non-conductive materials so that the coating and the substrate do not themselves heat up under the influence of the high frequency electrical field sufficiently to raise the temperatures of the micro-capsules 26.

When light enters through the optical lens 36 and impinges upon the micro-capsules 26, the photoconductive material within the micro-capsules become more conductive and the resistivity of the encapsulated material as a whole substantially decreases. In accordance with well known principles, the high frequency electrical field acts upon the lower resistance micro-capsules and causes substantial current to flow within the micro-capsules. These currents generate substantial amounts of heat within the micro-capsules 26 by reason of absorption of radiant energy of the high frequency electrical field. The rise in temperature of the micro-capsules causes the same to expand. When a point is reached when the mantles 12 have been subjected to an internal pressure of a predetermined degree, the mantles break and the liquid or encapsulated material therein is released. It should be clear that only those micro-capsules 26 upon which light impinges are caused to rupture, the balance of the micro-capsules retaining their high electrical resistivity and therefore failing to absorb sufficient energy to become heated to the required extent. This represents selective rupture of the micro-capsules distributed over a surface area. However, where it is desirable to simultaneously rupture all micro-capsules, it is clear that all micro-capsules must similarly be exposed to light. Where an image is focused on a capsular plane, as described with reference to FIG. 1, only selected ones of the capsules are exposed to sufficient light and, for this reason, a photographic reproduction may be formed since the pattern of the ruptured capsules take on the general outline of the object image.

The arrangement illustrated in FIG. 1 is particularly suitable for monochromatic photography where the capsules 26 are filled with the same dye precursor or color progenitor material and the mantles 12 transmit substantial portions of the visible spectrum to which the photoconductive material must react.

To utilize the arrangement shown in FIG. 1 for color photography, it is necessary to divide the micro-capsules into a plurality of interspersed groups, with each group of micro-capsules including a different color progenitor material. The groups of micro-capsules are now randomly dispersed over the focal plane surface as shown in FIG. 1. With such an arrangement, the mantles of the capsules in each group are made of a light transmissive material having a color corresponding to the respective color progenitor material within the capsules in that group. In this manner, the contents of the capsules are selectively released over the surface as a function of the corresponding color components in the incident light upon the micro-capsular material and the resulting reproduction of the image also corresponds to the spectral distribution in the incident light.

Advantageously, the mantles 12, in the color photography photographic reproducing medium, correspond to the three primary colors. The mantles in each group are transparent but also act as a filter which only permit a single primary color light to pass therethrough for acting upon the photoconductive material. Clearly, with such an arrangement, the color which the mantle passes corresponds to the color of the dye precursor or the color which it will form once the mantle is ruptured.

Figure 3:
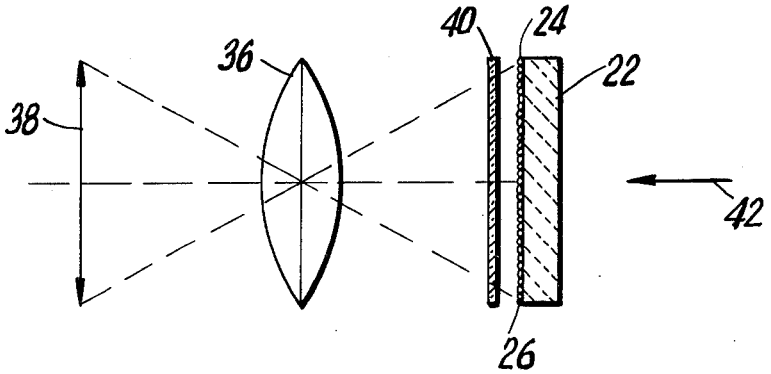
FIG. 3 is similar to FIG. 1, wherein an optical color filter is interposed between the lens of the apparatus and the recording material.

An alternate arrangement for color photography will not be described in reference to FIG. 3. In this arrangement, the mantles 12 of all the micro-capsules may be clear and, as opposed to the above described colored filtering mantles, may transmit substantial portions of the visible spectrum, including the three primary colors. To provide the color selectivity in this arrangement, the photoconductive material must only respond to one of the three primary colors. In effect, in each case of color photography, the micro-capsules must be so adapted to exhibit color selectivity, wherein the color to which the capsule is selectively receptive must correspond to that color which the capsule is intended to generate upon rupture.

The incident light which passes through the optical lens 30 and is focused upon the base coating 24 contains the three primary color components. Accordingly, if the micro-capsules 26 on the substrate 22 are divided into a plurality of interspersed groups, with each group including a different color progenitor material, and the mantles of all the micro-capsules are clear and light transmissive, the incident or white light which impinges upon the micro-capsules will simultaneously cause the corresponding micro-capsules to rupture when an appropriate light color component impinges on the same.

With the micro-capsules broken up into three groups as suggested above in reference to FIG. 3, color reproduction may also be performed in successive steps wherein the capsules in each group are independently or successively ruptured with the aid of optical filters 40 which correspond to the primary colors and are successively interposed between the micro-capsules 26 at the focal plane and the lens 36 or the source of incident light. Now, when a red optical filter 40 is placed as shown in FIG. 3, only those micro-capsules having encapsulated materials sensitive to the red component of light will absorb the radiant energy, indicated by the arrow 42, and rupture to release the "red" color progenitor or precursor materials. Similar results will be reached when the other primary optical color filters are successively placed in the light filtering positions. In effect, the successive use of primary color filters is analogous or is a substitute for the filtering effect of the colored mantles first described above in connection with color photography.

While the above refers to photography, wherein an image is focused upon micro-capsules at a focal plane to thereby cause light to selectively impinge upon micro-capsules, it is also possible to apply a uniform beam of incident light on all the micro-capsules and cause their simultaneous rupture at a predetermined event or condition. This may have numerous uses depending on the micro-capsular content which is to be released.

Figure 4:
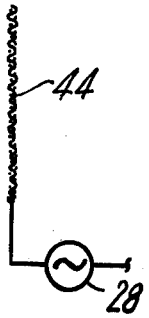
FIG. 4 illustrates a second embodiment for an electrically conductive light transmissive plate for replacing one of the plates in FIG. 1.

Referring to FIG. 4, there is shown an alternate embodiment of the conductive element disposed between the focal plane and the optical lens 36 in FIG. 1. Here, the glass layer 32 and tin oxide coating 34 are replaced by a foraminous conductive member 44, which may be in the form of a screen mesh. Such a screen mesh provides the required conductivity for establishing the high frequency energy or radiation field while permitting incident light to pass therethrough for impinging upon the micro-capsules 26.

The micro-capsular material, above described, and the method of releasing material from micro-capsules above suggested is particularly simple and economical. The method of exposing the micro-capsules of the type above described to high frequency electrical energy and simultaneously directing light at selected ones of the micro-capsules may also be used for printing, electronic writing or charting. In these applications, the micro-capsules are always exposed to the high frequency electrical energy or radiation as above described. However, instead of focusing an image of an object, in the photography sense, on the micro-capsules, a beam or beams may scan across the micro-capsular surface causing only the few micro-capsules intercepted by the beam to rupture. In this instance, the micro-capsular contents also advantageously include color progenitor materials and, of course, photoconductive material.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. Micro-capsular material for use as a photographic reproducing medium, said material comprising a plurality of micro-capsules, each of said capsules being provided with a mantle of light transmissive material, each of said capsules encapsulating photoconductive means within said capsular mantle to rupture said capsular mantle for selectively releasing its contents in a predetermined area when said capsular mantle is simultaneously exposed to light and high frequency electrical energy of predetermined levels, electrical resistivity of the encapsulated photoconductive means being decreased upon the exposure to light to increase absorption of the high frequency electrical energy for raising internal temperature and pressure within said capsular mantle to rupture said capsular mantle, said photoconductive means including a photoconductive material.

2. Micro-capsular material as defined in claim 1, wherein said contents of said capsules includes a color progenitor material, whereby rupture of the capsules results in color upon reaction of the capsular material.

3. Micro-capsular material as defined in claim 1, wherein said mantles are transparent.

4. A micro-capsular material as defined in claim 1, wherein said micro-capsules are divided into a plurality of interspersed groups, each group of micro-capsules including a different color progenitor material, said groups of micro-capsules being interspersed over a surface, the mantles of the capsules in each group being made of a light transmissive material having a color corresponding to the respective color progenitor material within the capsules in that group, whereby the contents of the capsules is selectively released over said surfaces as a function of the corresponding color components in the incident light upon the micro-capsular material and the resulting reproduction of an image corresponds to the spectral distribution in the incidental light.

5. A micro-capsular material as defined in claim 1, wherein said micro-capsules are divided into a plurality of interspersed groups, each group including a different color progenitor material, and the mantles of all of said micro-capsules being clear and light transmissive and further including a plurality of optical filters each of which corresponds to a different color associated with a color progenitor material in one of said groups of microcapsules, each of said optical filters being successively interposable between said micro-capsules and a source of light, whereby successive filtering of the incident light by said optical filters prior to being directed at said micro-capsules causes the micro-capsules with the color progenitor material corresponding to the respective optical filter to rupture and a reproduction of an image results which includes the spectral distribution in the incident light.

6. A photographic reproducing material comprising an electrically non-conductive base layer, a coating of micro-capsules on said base layer, each of said capsules being provided with a mantle of light transmissive material, each of said capsules encapsulating photoconductive means within said capsular mantle to rupture said capsular mantle for selectively releasing its contents in a predetermined area when said capsular mantle is simultaneously exposed to light and high frequency electrical energy of predetermined levels, electrical resistivity of the encapsulated photoconductive means being decreased upon the exposure to light to increase absorption of the high frequency electrical energy for raising internal temperature and pressure within said capsular mantle to rupture said capsular mantle, said photoconductive means including a photoconductive material and a color progenitor, whereby selective application of light from an image on said base layer causes only those micro-capsules exposed to the predetermined light level to rupture with attendant dispersion of the color progenitor on said base layer to thereby form a reproduction of the image on said base layer.

* * * * *